US011809107B2

(12) United States Patent
Tokuda et al.

(10) Patent No.: US 11,809,107 B2
(45) Date of Patent: Nov. 7, 2023

(54) FIXING DEVICE AND IMAGE FORMING APPARATUS INCORPORATING SAME

(71) Applicants: Tetsuo Tokuda, Tokyo (JP); Akiyasu Amita, Kanagawa (JP); Fumihiro Hirose, Kanagawa (JP); Daisuke Arai, Tokyo (JP)

(72) Inventors: Tetsuo Tokuda, Tokyo (JP); Akiyasu Amita, Kanagawa (JP); Fumihiro Hirose, Kanagawa (JP); Daisuke Arai, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/901,873

(22) Filed: Sep. 2, 2022

(65) Prior Publication Data

US 2023/0136994 A1 May 4, 2023

(30) Foreign Application Priority Data

Oct. 28, 2021 (JP) ..... 2021-176296

(51) Int. Cl.
*G03G 15/20* (2006.01)

(52) U.S. Cl.
CPC ..... *G03G 15/2039* (2013.01)

(58) Field of Classification Search
CPC ..... G03G 15/2039; G03G 15/2025; G03G 15/2042; G03G 15/2046
See application file for complete search history.

(56) References Cited

U.S. PATENT DOCUMENTS

2009/0297233 A1* 12/2009 Kameda ..... G03G 15/5029 399/322
2013/0058672 A1 3/2013 Takada et al.
2013/0136480 A1* 5/2013 Hasegawa ..... G03G 15/2039 399/69

(Continued)

FOREIGN PATENT DOCUMENTS

JP 2008-096728 4/2008
JP 2013-054108 3/2013

(Continued)

OTHER PUBLICATIONS

Extended European Search Report dated Mar. 13, 2023 in European Patent Application No. 22202058.8, 8 pages.

*Primary Examiner* — Sevan A Aydin
(74) *Attorney, Agent, or Firm* — XSENSUS LLP

(57) ABSTRACT

A fixing device includes a heater, a fixing rotator, a first temperature sensor, a second temperature sensor, a contact rotator, and circuitry. The fixing rotator has an outer circumferential surface having a first area and a second area. The first area contacts both a first sheet and a second sheet having a width narrower than the width of the first sheet. The second area contacts the first sheet but does not contact the second sheet. The first temperature sensor detects a first temperature of the first area. The second temperature sensor detects a second temperature of the second area. The contact rotator contacts both the first area and the second area and rotates at the one of at least two relative velocities with respect to the fixing rotator. The circuitry sets one of the at least two relative velocities based on the first temperature and the second temperature.

8 Claims, 8 Drawing Sheets

(56) References Cited

U.S. PATENT DOCUMENTS

| | | | |
|---|---|---|---|
| 2015/0286172 | A1 | 10/2015 | Hosokawa et al. |
| 2019/0011864 | A1 | 1/2019 | Kawata et al. |
| 2019/0018348 | A1 | 1/2019 | Watanabe et al. |
| 2019/0018351 | A1 | 1/2019 | Hirose et al. |
| 2020/0174406 | A1 | 6/2020 | Arai |
| 2021/0096488 | A1 | 4/2021 | Hirose et al. |
| 2022/0082968 | A1 | 3/2022 | Amita et al. |

FOREIGN PATENT DOCUMENTS

| | | |
|---|---|---|
| JP | 2013-109270 | 6/2013 |
| JP | 2017-156408 A | 9/2017 |
| JP | 2021-063856 | 4/2021 |

* cited by examiner

FIXING DEVICE AND IMAGE FORMING APPARATUS INCORPORATING SAME

CROSS-REFERENCE TO RELATED APPLICATION

This patent application is based on and claims priority pursuant to 35 U.S.C. § 119(a) to Japanese Patent Application No. 2021-176296, filed on Oct. 28, 2021, in the Japan Patent Office, the entire disclosure of which is hereby incorporated by reference herein.

BACKGROUND

Technical Field

Embodiments of the present disclosure generally relate to a fixing device and an image forming apparatus incorporating the fixing device.

Related Art

One type of image forming apparatus includes a fixing device. The fixing device includes a fixing rotator. The outer circumferential surface of the fixing rotator is heated and brought into contact with a sheet to fix an image onto the sheet.

SUMMARY

This specification describes an improved fixing device that includes a heater, a fixing rotator, a first temperature sensor, a second temperature sensor, a contact rotator, and circuitry. The fixing rotator has an outer circumferential surface to be heated by the heater and come into contact with a sheet to fix an image onto the sheet. The outer circumferential surface has a first area to come into contact with both a first sheet having a first sheet width and a second sheet having a second sheet width narrower than the first sheet width and a second area to come into contact with the first sheet and not to come into contact with the second sheet. The first temperature sensor detects a first temperature of the first area. The second temperature sensor detects a second temperature of the second area. The contact rotator comes into contact with both the first area and the second area and rotate at one of at least two relative velocities with respect to the fixing rotator. The circuitry sets the one of the at least two relative velocities based on the first temperature and the second temperature.

This specification also describes an improved image forming apparatus that includes a heater, a fixing rotator, a first temperature sensor, a second temperature sensor, a contact rotator, and circuitry. The fixing rotator has an outer circumferential surface to be heated by the heater and come into contact with a sheet to fix an image onto the sheet. The outer circumferential surface has a first area to come into contact with both a first sheet having a first sheet width and a second sheet having a second sheet width narrower than the first sheet width and a second area to come into contact with the first sheet and not to come into contact with the second sheet. The first temperature sensor detects a first temperature of the first area. The second temperature sensor detects a second temperature of the second area. The contact rotator comes into contact with both the first area and the second area and rotate at one of at least two relative velocities with respect to the fixing rotator. The circuitry sets the one of the at least two relative velocities based on the first temperature and the second temperature.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
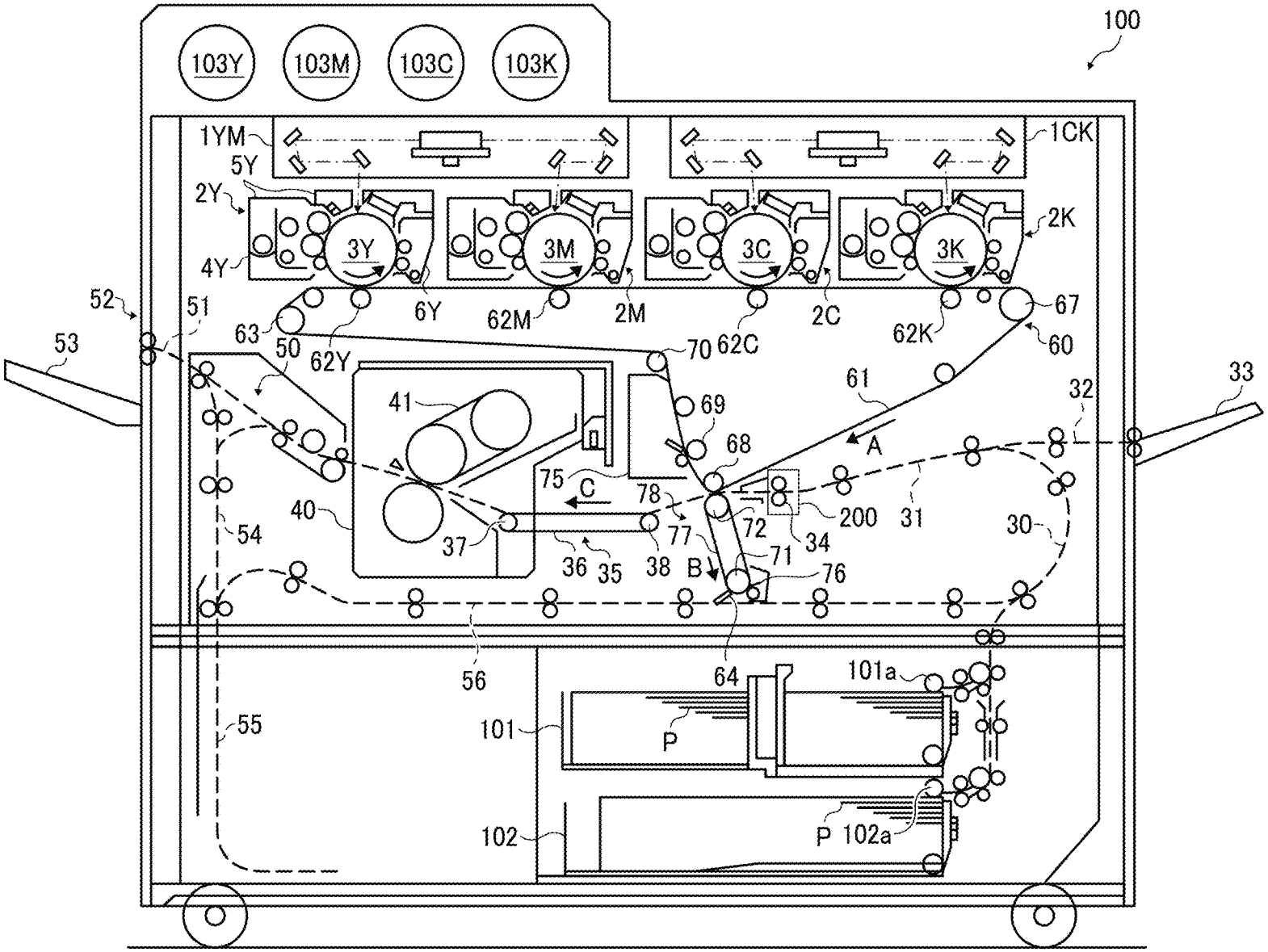
FIG. 1 is a schematic sectional view of an image forming apparatus according to an embodiment of the present disclosure.

The accompanying drawings are intended to depict embodiments of the present invention and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity.

However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise. Identical reference numerals are assigned to identical components or equivalents and a description of those components is simplified or omitted.

A description is given of an image forming apparatus including a fixing device according to an embodiment of this disclosure.

FIG. 1 is a schematic sectional view of an image forming apparatus 100 according to the present embodiment that is illustrated as an example of an electrophotographic printer.

As illustrated in FIG. 1, the image forming apparatus 100 according to the present embodiment includes four image forming units 2Y, 2M, 2C, and 2K to form toner images of yellow, magenta, cyan, and black, respectively. It is to be noted that the suffixes Y, M C, and K denote colors of yellow, magenta, cyan, and black, respectively. To simplify the description, the suffixes Y, M, C, and K indicating colors may be omitted herein, unless differentiation of colors is necessary. The image forming apparatus 100 is a tandem type image forming apparatus in which the four image forming units 2Y, 2M, 2C and 2K are aligned along a direction of movement of an intermediate transfer belt 61 as an image bearing belt.

The image forming apparatus 100 further includes a sheet feed passage 30, a pre-transfer sheet conveyance passage 31, a bypass sheet feed passage 32, a bypass tray 33, a pair of registration rollers 34, a conveyor belt unit 35, a fixing device 40, a conveyance direction switching device 50, a sheet ejection passage 51, a pair of sheet ejecting rollers 52, and a sheet ejection tray 53. The image forming apparatus 100 further includes two optical writing devices 1YM and 1CK, a primary transfer unit 60, a secondary transfer unit 78, a first sheet feeding tray 101 and a second sheet feeding tray 102.

The four image forming units 2Y, 2M, 2C and 2K include drum-shaped photoconductors 3Y, 3M, 3C and 3K that function as latent image bearers, respectively. Each of the first sheet feeding tray 101 and the second sheet feeding tray 102 contains a bundle of sheets P. The first sheet feeding tray 101 includes a first sheet feed roller 101*a*, and the second sheet feeding tray 102 includes a second sheet feed roller 102*a*. As a selected one of the first sheet feed roller 101*a* and the second sheet feed roller 102*a* is driven and rotated, an uppermost sheet P placed on the top of the sheet bundle is fed toward the sheet feed passage 30.

The image forming apparatus 100 includes a housing in which parts and components for image formation are contained. The bypass tray 33 is disposed openably and closably on a right side of the housing of the image forming apparatus 100 in FIG. 1. The bypass tray 33 is rotated away from the housing to open, and a sheet bundle of sheets P are loaded on a top face of the bypass tray 33. The uppermost sheet P on the top of the sheet bundle loaded on the bypass tray 33 is fed by a sheet feed roller included in the bypass tray 33, toward the bypass sheet feed passage 32 and conveyed to the sheet feed passage 30.

Each of the optical writing devices 1YM and 1CK includes a laser diode, a polygon mirror, various lenses. Based on image data that is optically read by a scanner disposed outside the housing of the image forming apparatus 100 or image data output from a personal computer disposed outside the image forming apparatus 100, each of the optical writing devices 1YM and 1CK emits laser light from a laser diode to optically scan the photoconductors 3Y, 3M, 3C and 3K of the image forming units 2Y, 2M, 2C and 2K, respectively. Specifically, a drive device drives the photoconductors 3Y, 3M, 3C, and 3K of the image forming units 2Y, 2M, 2C, and 2K to rotate in a counterclockwise direction in FIG. 1.

The optical writing device 1YM emits laser light beams to the photoconductor 3Y for forming yellow image and the photoconductor 3M for forming magenta image by deflecting the laser light beams in an axial direction of rotation of the photoconductors 3Y and 3M. Accordingly, respective surfaces of the photoconductors 3Y and 3M are optically scanned and irradiated. Accordingly, an electrostatic latent image based on yellow image data is formed on the photoconductor 3Y and an electrostatic latent image based on magenta image data is formed on the photoconductor 3M.

The optical writing device 1CK emits laser light beams to the photoconductor 3C for forming cyan image and the photoconductor 3K for forming black image by deflecting the laser light beams in an axial direction of rotation of the photoconductors 3C and 3K, respectively. Accordingly, respective surfaces of the photoconductors 3C and 3K are optically scanned and irradiated. Accordingly, an electrostatic latent image based on cyan image data is formed on the photoconductor 3C and an electrostatic latent image based on black image data is formed on the photoconductor 3K.

Each of the image forming units 2Y, 2M, 2C and 2K also includes various image forming components disposed around each of the photoconductors 3Y, 3M, 3C and 3K. Each of the photoconductors 3Y, 3M, 3C and 3K and the various image forming components are supported by a common supporting body (i.e., each of the image forming units 2Y, 2M, 2C and 2K) as a single unit. According to this configuration, each image forming unit 2 including each photoconductor 3 and various image forming components is attached to or detached from the housing of the image forming apparatus 100 integrally. The image forming units 2Y, 2M, 2C and 2K have respective configurations identical to each other except the colors of toners, and therefore are occasionally described without suffixes indicating the toner colors, which are Y, M, C, and K. Therefore, in the following description, suffixes K, Y, M, and C indicating the color of the toner to be used are appropriately omitted and occasionally described in a singular form when the configuration and functions of the process units 1K, 1Y, 1M, and 1C are explained.

The image forming unit 2 includes the photoconductor 3 and a developing device 4 that develops the electrostatic latent image formed on a surface of the photoconductor 3 into a visible toner image. The image forming unit 2 further includes a charging device 5 (i.e., charging devices 5Y, 5M, 5C and 5K) that uniformly charges a surface of the photoconductor 3 that is rotated by the drive device. The image forming unit 2 further includes a drum cleaning device 6 (i.e., drum cleaning devices 6Y, 6M, 6C and 6K). The drum cleaning device 6 removes transfer residual toner remaining on the surface of the photoconductor 3 after the photoconductor 3 has passed the primary transfer nip region and cleans the surface of the photoconductor 3.

The photoconductor 3 is manufactured by a hollow tube made of aluminum, for example, with a drum shaped body covered by an organic photoconductive layer having photosensitivity. It is to be noted that the photoconductors 3Y, 3M, 3C, and 3K may have an endless belt shape instead of a drum shape.

The developing device 4 (i.e., developing devices 4Y, 4M, 4C and 4K) includes a developing sleeve and a magnet roller. The developing sleeve is a tubular-shaped rotatable nonmagnetic body. The magnet roller is fixed inside the tube of the developing sleeve so as not to rotate together with the developing sleeve. Due to magnetic force generated by the magnet roller, an electrostatic latent image formed on the photoconductor 3 is developed into a visible toner image by a two-component developer, including magnetic carrier particles and nonmagnetic toner, borne on the surface of the developing sleeve. Hereinafter, the two-component developer is simply referred to as a "developer".

Yellow, magenta, cyan, and black toners stored in respective toner bottles 103Y, 103M, 103C and 103K are supplied appropriately by respective toner supplying devices to the developing devices 4Y, 4M, 4C and 4K, respectively. The developing device 4 includes a toner concentration sensor that functions as a toner concentration detector. The toner concentration sensor detects the permeability of the developer due to the magnetic carrier particles. A controller 400 controls driving of each toner supplying device based on a comparison obtained by an output value from the toner concentration sensor and an output value of a target output value that is a target toner concentration value, from the toner concentration sensor. Accordingly, the toner concentration of the developer is set to fall in a constant range, which is from 4 wt. % to 9 wt. %, for example.

The drum cleaning device 6 scrapes off transfer residual toner from the surface of the photoconductor 3 by a cleaning blade made by polyurethane rubber, while the cleaning blade is in contact with the photoconductor 3. It is to be noted that the drum cleaning device 6 is not limited thereto. This disclosure is applied to a drum cleaning device having a different configuration. In order to enhance the cleaning performance, the drum cleaning device 6 further includes a fur brush that has a rotary body in addition to the cleaning blade. The fur brush is also disposed in contact with the photoconductor 3. The fur brush also scrapes lubricant from solid lubricant to form fine powder and applies the fine powder onto the surface of the photoconductor 3.

An electric discharging lamp is disposed above the photoconductor 3. The electric discharging lamp is also a part of the image forming unit 2. Further, the electric discharging lamp optically emits light to the surface of the photoconductor 3 to remove electricity from the surface of the photoconductor 3 after the photoconductor 3 has passed a position opposed to the drum cleaning device 6. The electrically discharged surface of the photoconductor 3 is uniformly charged by the charging device 5. Then, each of the above-described optical writing devices 1YM and 1CK starts optical scanning. It is to be noted that the charging device 5 rotates while receiving the charging bias from a power source. Instead of this configuration, the charging device 5 may be a scorotron charging system in which a charging operation is performed without contacting the photoconductor 3.

The primary transfer unit 60 is disposed below the four image forming units 2Y, 2M, 2C and 2K. The primary transfer unit 60 includes the intermediate transfer belt 61 stretched in a tensioned condition by multiple rollers 63, 67, 69 and 70 and a secondary transfer bias roller 68. In the primary transfer unit 60, the intermediate transfer belt 61 is in contact with the photoconductors 3Y, 3M, 3C, and 3K. One of the multiple rollers 63, 67, 69 and 70 and the secondary transfer bias roller 68 drives and rotates the intermediate transfer belt 61 in a clockwise direction that is a direction indicated by arrow A in FIG. 1. The portions where the photoconductors 3Y, 3M. 3C, and 3K are in contact with the intermediate transfer belt 61 are called primary transfer nips.

In the vicinity of each of the primary transfer nip, primary transfer rollers 62Y, 62M, 62C and 62K are disposed in contact with an inner circumferential surface of the intermediate transfer belt 61 to press the intermediate transfer belt 61 against the photoconductors 3Y, 3M, 3C and 3K, respectively. Primary transfer power sources apply primary transfer biases to the primary transfer rollers 62Y, 62M, 62C and 62K, respectively. The primary transfer biases form primary transfer electric fields in the primary transfer nips to electrostatically transfer the yellow, magenta, cyan and black toner images on the photoconductors 3Y, 3M, 3C, and 3K onto the intermediate transfer belt 61, respectively.

Along with the endless movement of the intermediate transfer belt 61 in the clockwise direction A in FIG. 1, the intermediate transfer belt 61 passes through the respective primary transfer nips for the yellow, magenta, cyan and black toner images sequentially. At the primary transfer nips, the yellow, magenta, cyan and black toner images are sequentially transferred and overlaid onto the outer circumferential surface of the intermediate transfer belt 61 for primary transfer. The above-described primary transfer process superimposing the toner images forms a four color superimposed toner image on the outer circumferential surface of the intermediate transfer belt 61.

The secondary transfer unit 78 is disposed below the intermediate transfer belt 61 in FIG. 1. This secondary transfer unit 78 includes a secondary transfer belt 77 having an endless loop, a grounding driven roller 72, a secondary transfer drive roller 71, a secondary belt cleaning device 76, and a toner adhesion amount detecting sensor 64. While being stretched in a tensioned condition by the grounding driven roller 72 disposed inside the endless loop and the secondary transfer drive roller 71, the secondary transfer belt 77 is moved endlessly in a counterclockwise direction as indicated by arrow B in FIG. 1, along with rotation of the secondary transfer drive roller 71.

The secondary transfer belt 77 of the secondary transfer unit 78 is wound around the grounding driven roller 72, and the intermediate transfer belt 61 of the primary transfer unit 60 is wound around the secondary transfer bias roller 68. The secondary transfer belt 77 at a contact portion contacting the grounding driven roller 72 is pressed against the intermediate transfer belt 61 at a contact portion contacting the secondary transfer bias roller 68. Thus, a secondary transfer nip is formed in a portion in which the secondary transfer belt 77 and the intermediate transfer belt 61 contact each other. A secondary transfer bias that is output from a secondary transfer power source is applied to the secondary transfer bias roller 68 disposed inside the loop of the intermediate transfer belt 61. By contrast, the grounding driven roller 72 disposed inside the loop of the secondary transfer belt 77 is grounded. Thus, a secondary transfer electric field is formed in the secondary transfer nip.

The pair of registration rollers 34 is disposed on the right side of the secondary transfer nip in FIG. 1. The pair of registration rollers 34 holds the sheet P between the rollers thereof to convey the sheet P to the secondary transfer nip in synchronization with arrival of the four-color toner image formed on the intermediate transfer belt 61 (at a time at which the sheet P and the four-color toner image are conveyed to meet each other at the same time). In the secondary transfer nip, the four-color toner image formed on the intermediate transfer belt 61 is transferred collectively onto the sheet P due to the secondary transfer electric field and the nip pressure. At this time, the four-color toner image is combined with white color of the sheet P to make a full color image.

After passing through the secondary transfer nip, secondary transfer residual toner that has not been transferred onto the sheet P remains on the outer circumferential surface of the intermediate transfer belt 61. An intermediate transfer belt cleaning device 75 provided to the primary transfer unit 60 removes the secondary transfer residual toner from the surface of the intermediate transfer belt 61.

After passing through the secondary transfer nip, the sheet P is separated from the intermediate transfer belt 61 and the secondary transfer belt 77 to be conveyed toward the conveyor belt unit 35. In the conveyor belt unit 35, an endless conveyor belt 36 is entrained around a driving roller 37 and a driven roller 38, and the driving roller 37 is driven to rotate the conveyor belt 36 counterclockwise in FIG. 1 (in a direction indicated by arrow C). After the sheet P has passed through the secondary transfer nip, an upper stretched surface of the conveyor belt 36 receives the sheet P, and rotation of the conveyor belt 36 conveys the sheet P toward the fixing device 40.

The fixing device 40 includes a fixing belt 41 having an endless loop and a pressure roller 44. The fixing belt 41 and the pressure roller 44 contact to form a fixing nip therebetween. The sheet P conveyed to the fixing device 40 is nipped in the fixing nip. Pressure and heat in the fixing nip fixes the toner image onto the surface of the sheet P.

The toner image is transferred onto a first face of the sheet P in the secondary transfer nip and is fixed to the first face of the sheet P in the fixing device 40. Thereafter, the sheet P is conveyed toward the conveyance direction switching device 50. The image forming apparatus 100 further includes a sheet reversing device including the conveyance direction switching device 50, a re-entry passage 54, a switchback passage 55, and a post-switchback passage 56. The conveyance direction switching device 50 switches a route of conveyance of the sheet P after the sheet P is output from the fixing device 40, between the sheet ejection passage 51 and the re-entry passage 54.

Specifically, when performing a print job in a single-side printing mode in which an image is formed on a single side, i.e., the first face of the sheet P, the conveyance direction switching device 50 selects the route of conveyance of the sheet P to the sheet ejection passage 51. According to the setting, the sheet P having the image on the first face is conveyed toward the pair of sheet ejecting rollers 52 via the sheet ejection passage 51 to be ejected to the sheet ejection tray 53 that is attached to an outside of the image forming apparatus 100. Further, when performing a print jot in a duplex printing mode in which respective images are formed on both sides, i.e., the first face and a second face of the sheet P, the conveyance direction switching device 50 receives the sheet P having fixed images on both first and second faces from the fixing device 40 and also selects the route of conveyance of the sheet P to the sheet ejection passage 51. According to the setting, the sheet P having images on both first and second faces is conveyed and ejected to the sheet ejection tray 53.

By contrast, the conveyance direction switching device 50 selects a route of conveyance of the sheet P to the re-entry passage 54 to perform a print job in the duplex printing mode after the sheet P having a fixed image on the first face alone is conveyed from the fixing device 40. The re-entry passage 54 is connected to the switchback passage 55. The sheet P conveyed to the re-entry passage 54 enters the switchback passage 55. Consequently, when the entire region of the sheet P in the sheet conveying direction enters the switchback passage 55, the route of conveyance of the sheet P is reversed, so that the sheet P is switched back in the reverse direction.

The switchback passage 55 is connected to the post-switchback passage 56 as well as the re-entry passage 54. The sheet P that has been switched back in the reverse direction enters the post-switchback passage 56. At this time, the faces of the sheet P are reversed. Consequently, the reversed sheet P is conveyed to the secondary transfer nip again via the post-switchback passage 56 and the sheet feed passage 30. A toner image is transferred onto the second face of the sheet P in the secondary transfer nip. Thereafter, the sheet P is conveyed to the fixing device 40 so as to fix the toner image to the second face of the sheet P. Then, the sheet P passes through the conveyance direction switching device 50, the sheet ejection passage 51, and the pair of sheet ejecting rollers 52 before being ejected on the sheet ejection tray 53.

Figure 2:
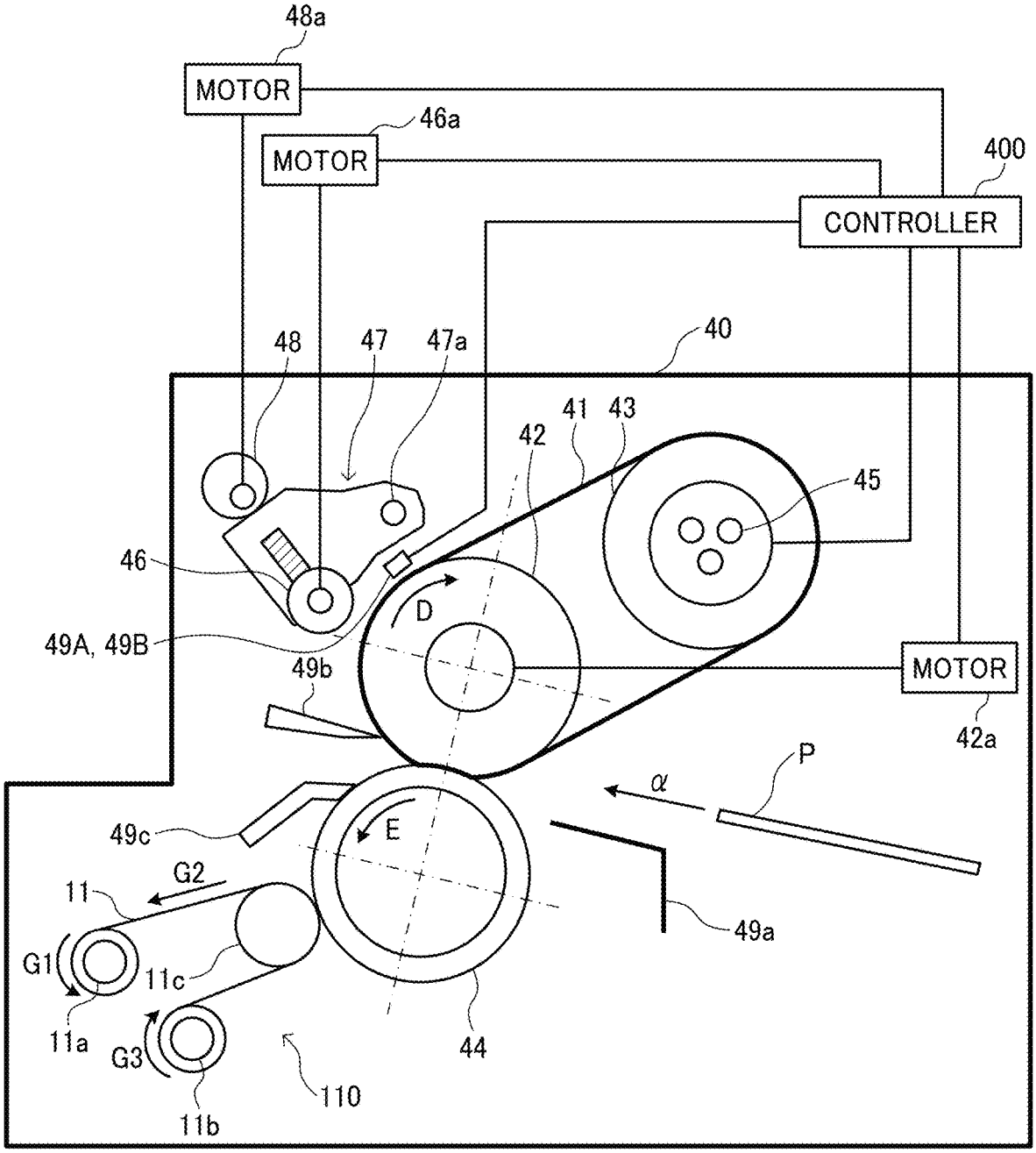
FIG. 2 is a schematic sectional view of a fixing device in the image forming apparatus of FIG. 1 in a cross section orthogonal to the axis of a fixing roller and the axis of a heating roller.
Figure 3:
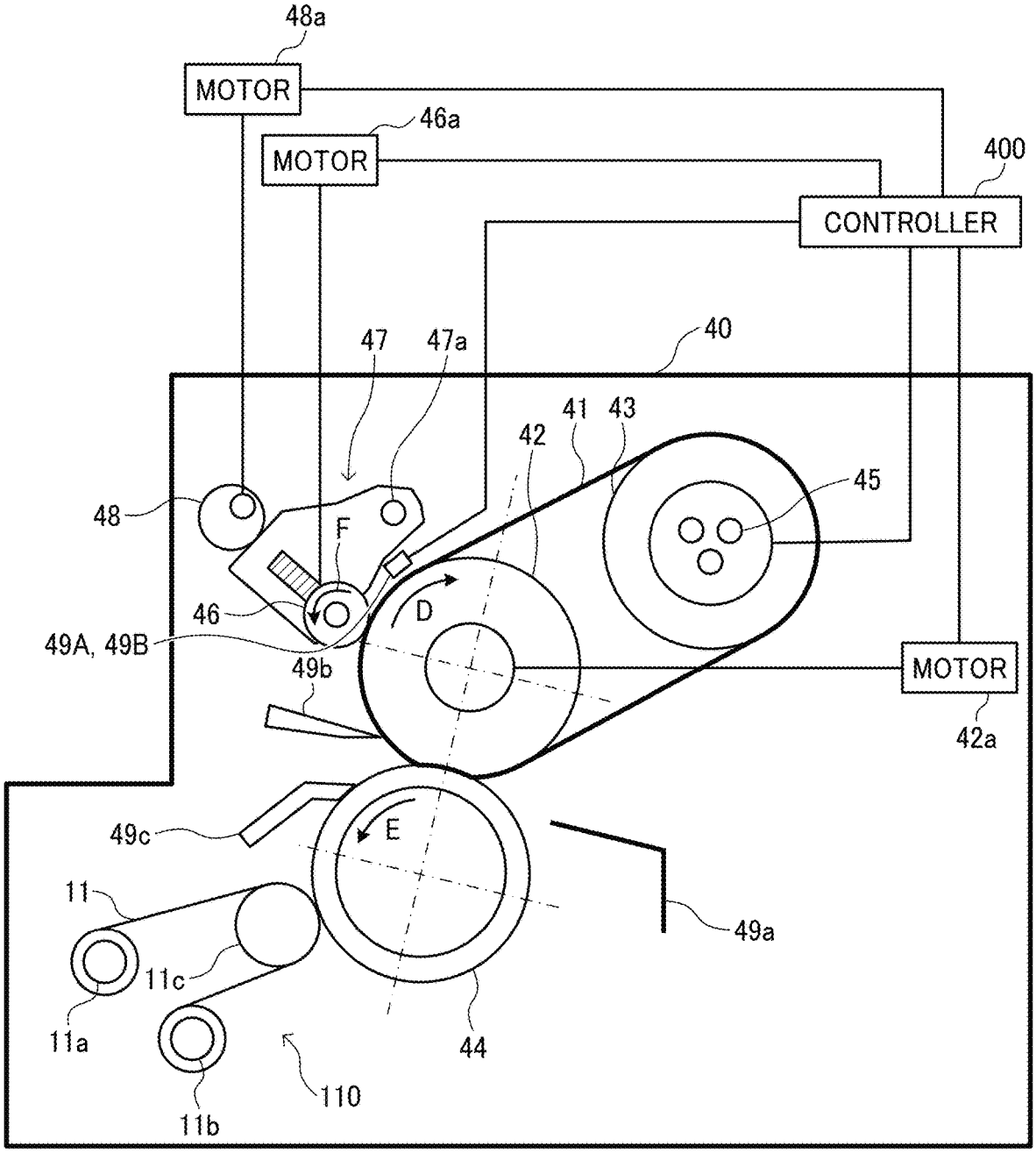
FIG. 3 is a schematic sectional view of the fixing device in the image forming apparatus of FIG. 1 in the cross section orthogonal to the axis of the fixing roller and the axis of the heating roller.

FIGS. 2 and 3 are schematic sectional views of the fixing device 40 according to the present embodiment in a cross section orthogonal to the axis of a fixing roller 42 and the axis of a heating roller 43 to illustrate a configuration of the fixing device 40.

Figure 4:
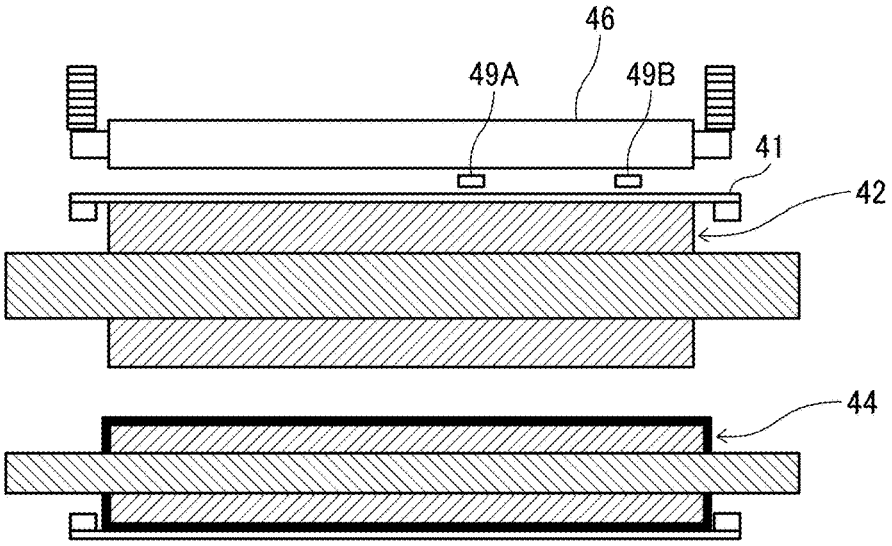
FIG. 4 is a schematic sectional view of the fixing device in the image forming apparatus of FIG. 1, taken along in an axial direction of the fixing roller and an axial direction of the heating roller.

FIG. 4 is a schematic sectional view of the fixing device 40, taken along in an axial direction of the fixing roller 42 and an axial direction of the heating roller 43 to illustrate the configuration of the fixing device 40.

The fixing device 40 illustrated in FIGS. 2 and 3 includes the fixing belt 41 that is in contact with the surface of the sheet P having an unfixed toner image formed on the surface of the sheet P. The fixing belt 41 is stretched by the fixing roller 42 and the heating roller 43. The fixing roller 42 is a fixing belt drive roller, and the heating roller 43 is a fixing belt driven roller. The fixing belt 41, the fixing roller 42, and the heating roller 43 configure a fixing rotator. As the fixing roller 42 is driven and rotated in the clockwise direction as indicated by arrow D in each of FIGS. 2 and 3, the fixing belt 41 is rotated in the clockwise direction in each of FIGS. 2 and 3.

The heating roller 43 is a heater that is a rotator including a fixing heater 45. The fixing roller 42 is a rotator that functions as a fixing nip forming body to stretch the fixing belt 41 together with the heating roller 43. The fixing heater 45 heats the heating roller 43, and the heating roller 43 heats the fixing belt 41.

In the fixing device 40, the pressure roller 44 is disposed below the fixing roller 42. The pressure roller 44 is disposed facing the fixing roller 42 with the fixing belt 41 interposed therebetween. The pressure roller 44 is pressed against the fixing roller 42 via the fixing belt 41 by a pressing mechanism. The fixing belt 41 is rotated along with rotation of the fixing roller 42 driven by a driving mechanism. The pressure roller 44 is rotated by rotation of the fixing belt 41, in the counterclockwise direction as indicated by arrow E in each of FIGS. 2 and 3.

The fixing device 40 includes two temperature sensors that are a center temperature sensor 49A as a first temperature sensor and an end temperature sensor 49B as a second temperature sensor that are described below. The two temperature sensors 49A and 49B each detect a surface temperature of the fixing belt 41. The controller 400 that is circuitry functions as a temperature controller and controls the fixing heater 45 based on output values of the center temperature sensor 49A so that the surface temperature of the fixing belt 41 is a target temperature. As an example of control of the fixing heater 45, an ON/OFF control or a proportional integral differential (PID) control is used.

The sheet P having the unfixed toner image thereon is conveyed along an entrance guide plate 49*a* to the fixing device 40 as indicated by arrow α in FIG. 2. Then, the sheet P passes through the fixing nip formed between the pressure roller 44 and the fixing belt 41 supported by the fixing roller 42. The toner image on the sheet P is melted and fixed to the sheet P in the fixing nip formed between the pressure roller 44 and the fixing belt 41 because the temperature of the fixing belt 41 is controlled to be the target temperature. After the sheet P passes through the fixing nip, a fixing separation plate 49*b* or a pressure separation claw 49*c* separate the sheet P from the fixing belt 41 or the pressure roller 44 at a fixing nip exit. Then, the sheet P passes through the sheet conveyance passage and the sheet ejection passage 51 in the conveyance direction switching device 50 and is ejected to an outside of the image forming apparatus 100 onto the sheet ejection tray 53.

As illustrated in FIGS. 2 and 3, the fixing device 40 includes a pressure roller cleaning device 110 to clean the surface of the pressure roller 44. The pressure roller cleaning device 110 includes a cleaning web 11 that functions as a band-shaped cleaner, a web holding shaft 11*b*, a web take-up shaft 11*a*, and a web contact roller 11*c*. One end of the cleaning web 11 is fixed to the web take-up shaft 11*a*, and the other end of the cleaning web 11 is fixed to the web holding shaft 11*b*. The web contact roller 11*c* presses the cleaning web 11 between the web take-up shaft 11*a* and the web holding shaft 11*b* against the surface of the pressure roller 44.

The web take-up shaft 1*a* is driven and rotated in a direction indicated by arrow G1 in FIG. 2, so that the cleaning web 11 is taken up. A part of the cleaning web 11 contacts and cleans the pressure roller 44 and moves in a direction indicated by arrow G2 in FIG. 2. Subsequently, an unused part of the cleaning web 11 contacts the pressure roller 44. The unused part of the cleaning web 11 is taken up to the web holding shaft 11*b*. Moving the cleaning web 11 in the direction indicated by arrow G2 in FIG. 2 pulls the cleaning web 11, and the pulled cleaning web 11 rotates the web holding shaft 11*b* in a direction indicated by arrow G3 in FIG. 2. By so doing, the unused part of the cleaning web 11 is conveyed toward a contact portion at which the unused part of the cleaning web 11 contacts the pressure roller 44. The pressure roller cleaning device 110 uses the unused part of the cleaning web 11 as a cleaner, that is, the part of the cleaner in which no foreign material is attached to continuously clean the pressure roller 44. Accordingly, the pressure roller 44 may be continuously maintained in a state in which there is no foreign material on the surface thereof.

After some sheets P each having a width narrower than the maximum sheet width are printed and pass through the fixing device, the following abnormal image may occur in an image having a large toner adhesion amount and being printed on the sheet P having a wider width than the sheets P each having the width narrower than the maximum sheet width. Specifically, in a sheet width direction orthogonal to a sheet conveying direction of the sheet P that is the direction indicated by arrow α in FIG. 2, fixing properties in the image printed on the sheet having the wider width after some sheets having the narrower widths are printed are different between positions corresponding to both ends of the sheet having the narrower width and other positions on the image in the sheet having the wider width. The different fixing properties cause the abnormal image such as gloss streaks.

Figure 5:
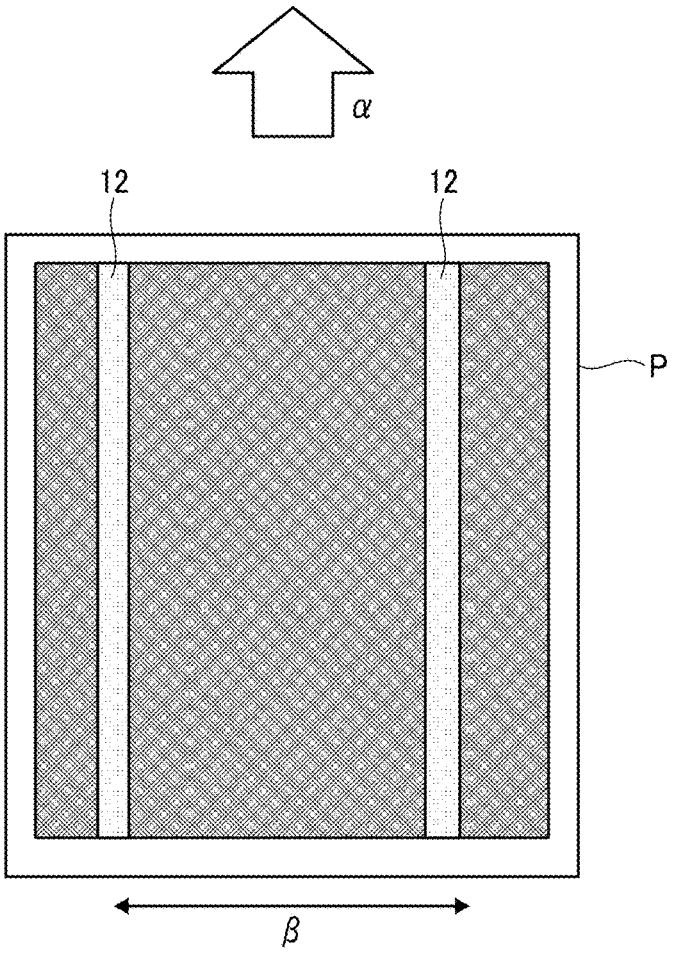
FIG. 5 is a schematic view of an example of a solid image having gloss streaks formed on a wide width sheet after some narrow width sheets P have been fed.

FIG. 5 is a schematic view of an example of a solid image having gloss streaks 12 formed on the sheet P having the wider width and being printed after some sheets having the narrower widths are printed.

In the example illustrated in FIG. 5, the gloss streaks 12 are stripes extending in the sheet conveyance direction and each having gloss different from other portions of the solid image and occur at two positions that are away from each other in the sheet width direction that is a direction indicated by arrow β in FIG. 5. The gloss streaks 12 are caused by the following reasons. When a predetermined number or more sheets P each having the width narrower than the maximum sheet width pass through the fixing device, burrs at both ends of sheet P in the sheet width direction repeatedly form sliding traces that are referred to as sheet edge streaks at same positions on the outer circumferential surface of the fixing belt 41. Repeatedly forming the sliding traces at the same positions generates edge scratches on the outer circumferential surface of fixing belt 41. Fixing the image on a portion having the edge scratches forms the gloss streak 12 on an output image.

The fixing device 40 according to the present embodiment includes a refresh roller 46 as a contact rotator that rubs the surface of the fixing belt 41. The refresh roller 46 is a polishing roller having a polishing layer as a surface layer around a cored bar made of metal. The refresh roller 46 is rotatably supported by a roller bracket 47. A motor 46*a* drives and rotates the refresh roller 46 in a corotating direction of the fixing belt 41 that is the direction indicated by arrow F in FIG. 3.

When the controller 400 performs a polishing mode, the refresh roller 46 is brought into contact with the outer circumferential surface of the fixing belt 41 as illustrated in FIG. 3 and driven to rotate at a predetermined relative velocity as a first relative velocity with respect to the fixing belt 41. As a result, the refresh roller 46 rubs and polishes the outer circumferential surface of the fixing belt 41. Polishing the fixing belt 41 as described above can reduce the sliding traces (that is, the sheet edge streaks) on the outer circumferential surface of the fixing belt 41 generated by the burrs at both ends of the sheet P in the sheet width direction. Accordingly, the gloss streaks 12 as illustrated in FIG. 5 is prevented from occurring or is made difficult to see even if generated.

Regarding the rotation speed of the refresh roller 46 in the fixing device 40 according to the present embodiment, the surface moving speed (that is a linear velocity) of the refresh roller 46 is preferably set to be in a range from three (3) to six (6) times faster than the surface moving speed (that is a linear velocity) of the fixing belt 41. If the surface moving speed of the refresh roller 46 is less than three times, sufficient polishing of the fixing belt 41 is not achieved. By contrast, if the surface moving speed of the refresh roller 46 exceeds six times, it is likely that the surface life of the fixing belt 41 is reduced. Setting the surface moving speed of the refresh roller 46 to be three to six times faster than the surface moving speed of the fixing belt 41 and polishing the fixing belt 41 can reduce the sliding traces on the fixing belt 41 and prevent a reduction in the service life of the fixing belt 41.

The refresh roller 46 according to the present embodiment is brought into contact with a part of the fixing belt 41 wrapped around the fixing roller 42. This configuration enables the fixing roller 42 to receive a pressing force of the refresh roller 46 pressing the fixing belt 41. As a result, the refresh roller 46 can contact the fixing belt 41 with a high contact pressure. The refresh roller 46 can polish the fixing belt 41 with a high polishing force.

In the present embodiment, a rotation shaft 47*a* supports the roller bracket 47 supporting the refresh roller 46 so that the roller bracket 47 can rotate about the rotation shaft 47*a*. A biasing member biases the roller bracket 47 so as to rotate about the rotation shaft 47*a* clockwise in FIG. 2. The biasing force of the biasing member presses the roller bracket 47 to contact a cam surface of an eccentric cam 48 and position the roller bracket 47.

The controller 40 controls a motor 48*a* to drive and rotate the eccentric cam 48. The controller 400 controls a rotation position of the eccentric cam 48. During image forming operations (at least while the sheet P passes through the fixing nip), the controller 400 controls the motor 4*ma* to rotate the eccentric cam 48 to the rotation position illustrated in FIG. 2, and the eccentric cam 48 moves the roller bracket 47 to the rotation position illustrated in FIG. 2. As a result, the refresh roller 46 is separated from the fixing belt 41.

After the image forming operations are finished (for example, after a job end), the controller 400 controls the motor 48*a* to rotate the eccentric cam 48 to the rotation position illustrated in FIG. 3, and the eccentric cam 48 moves the roller bracket 47 to the rotation position illustrated in FIG. 3. As a result, the refresh roller 46 is in contact with the fixing belt 41. Subsequently, the controller 400 executes the polishing mode to polish the outer circumferential surface of the fixing belt 41 and reduce the sliding traces (that is, sheet edge streaks) on the fixing belt 41.

Next, a temperature difference reduction mode, which is a feature of the present embodiment, is described.

Figure 6:
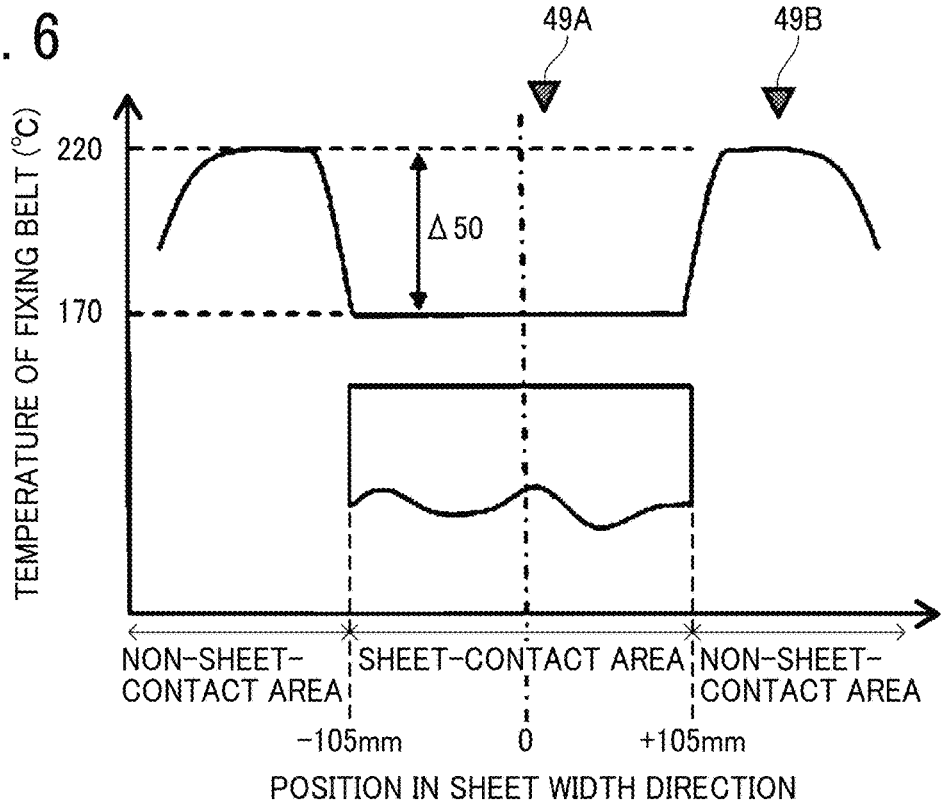
FIG. 6 is a graph illustrating a temperature distribution of a fixing belt in a sheet width direction after sheets having a sheet width narrower than the maximum sheet width continuously pass through the fixing device in the embodiment.

FIG. 6 is a graph illustrating a temperature distribution of the fixing belt 41 in the sheet width direction after the sheets P each having the sheet width narrower than the maximum sheet width continuously pass through the fixing device 40.

Figure 7:
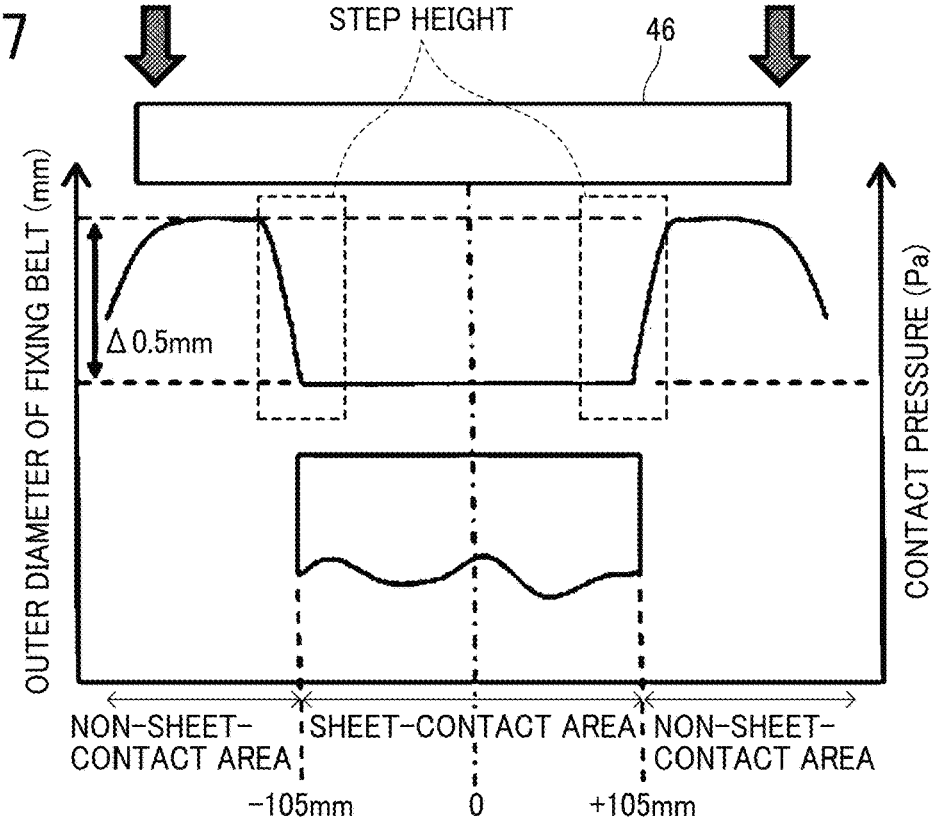
FIG. 7 is a graph illustrating an outer diameter profile of the fixing roller and a contact pressure distribution between the fixing belt and a refresh roller in the sheet width direction after the sheets having the sheet width narrower than the maximum sheet width continuously pass through the fixing device in the embodiment.

FIG. 7 is a graph illustrating an outer diameter profile of the fixing roller 42 and a contact pressure distribution between the fixing belt 41 and the refresh roller 46 in the sheet width direction after the sheets P each having the sheet width narrower than the maximum sheet width continuously pass through the fixing device 40.

Generally, in the sheet width direction (that is the rotation axis direction of the fixing belt 41), a sheet-contact area in which the sheet P comes into contact with the outer circumferential surface of the heated fixing belt 41 has a low temperature because heat is taken by the sheet P, and a non-sheet-contact area in which the sheet P does not come into contact with the outer circumferential surface of the heated fixing belt 41 has a high temperature because heat is not taken by the sheet P. In a case that the sheets P having the sheet width smaller than the maximum sheet width continuously pass through the fixing device, a temperature in the non-sheet-contact area, that is, a temperature in each of both end portions of the fixing belt 41 with which the sheets P do not come into contact is higher than a temperature in the sheet-contact area, that is, the center portion of the fixing belt 41 with which the sheets P come into contact as illustrated in FIG. 6.

The above-described large temperature difference between the sheet-contact area and the non-sheet-contact area after the sheets P each having the sheet width narrower than the maximum sheet width, which is referred to as the small sheets P, continuously pass through the fixing device 40 generates an uneven fixing temperature distribution in the sheet width direction when the fixing device fixes the image onto the sheet having the width larger than the small sheet P. Hereinafter, the sheet having the width larger than the small sheet P is referred to as a large sheet. Specifically, a sheet-contact area in which the fixing belt 41 is in contact with the large sheet includes the sheet-contact area of the small sheet P having a low temperature and the non-sheet-contact area of the small sheet P having a high temperature. As a result, the fixing temperature distribution for the large sheet has a low temperature portion at a center portion of the fixing belt in the sheet width direction and high temperature portions at both end portions of the fixing belt in the sheet width direction. An uneven fixing temperature distribution in the sheet width direction causes uneven fixing properties, which may cause an abnormal image having different image quality parts such as an uneven gloss.

In addition, the above-described large temperature difference between the sheet-contact area and the non-sheet-contact area causes a thermal expansion difference in outer diameters of the fixing roller 42. As illustrated in FIG. 7, the outer diameters at portions of the fixing roller 42 corresponding to the non-sheet-contact areas having the high temperature at both end portions of the fixing belt is larger than the outer diameter at a portion of the fixing roller 42 corresponding to the sheet-contact area having the low temperature at the center portion of the fixing belt. The above-described thermal expansion difference generates steps at boundaries between the center portion the fixing roller 42 and both end portions of the fixing roller 42, which also generates steps on the outer circumferential surface of the fixing belt 41 wrapped around the fixing roller 42.

For example, continuously passing the small sheets P through the fixing device may cause the temperatures at both end portions of the fixing belt 41 (that are the non-sheet-contact areas) to be 220° C. and the temperature at the center portion of the fixing belt 41 (that is the sheet-contact area) to be 170° C. (The temperature difference is 50° C.) as illustrated in FIG. 7. In this case, for example, the step height on the roller surface of the fixing roller 42 is about 0.5 mm as illustrated in FIG. 7.

The above-described step height generates an uneven contact pressure distribution between the fixing belt 41 and the refresh roller 46 that rubs and polishes the outer circumferential surface of the fixing belt 41 in the polishing mode. As illustrate in FIG. 7, the refresh roller 46 rubs both end portions of the fixing belt 41 that are the non-sheet-contact areas having the high temperature with a high contact pressure and rubs the center portion of the fixing belt 41 that is the sheet-contact area having the low temperature with a low contact pressure. As a result, the refresh roller 46 cannot suitably polish the portion of the fixing belt 41 in which the refresh roller 46 rubs the fixing belt 41 with the low contact pressure. The refresh roller 46 cannot reduce the sliding traces (that is, sheet edge streaks) formed on the outer circumferential surface of the fixing belt 41. The refresh roller 46 cannot prevent the occurrence of the uneven gloss.

Figure 8:
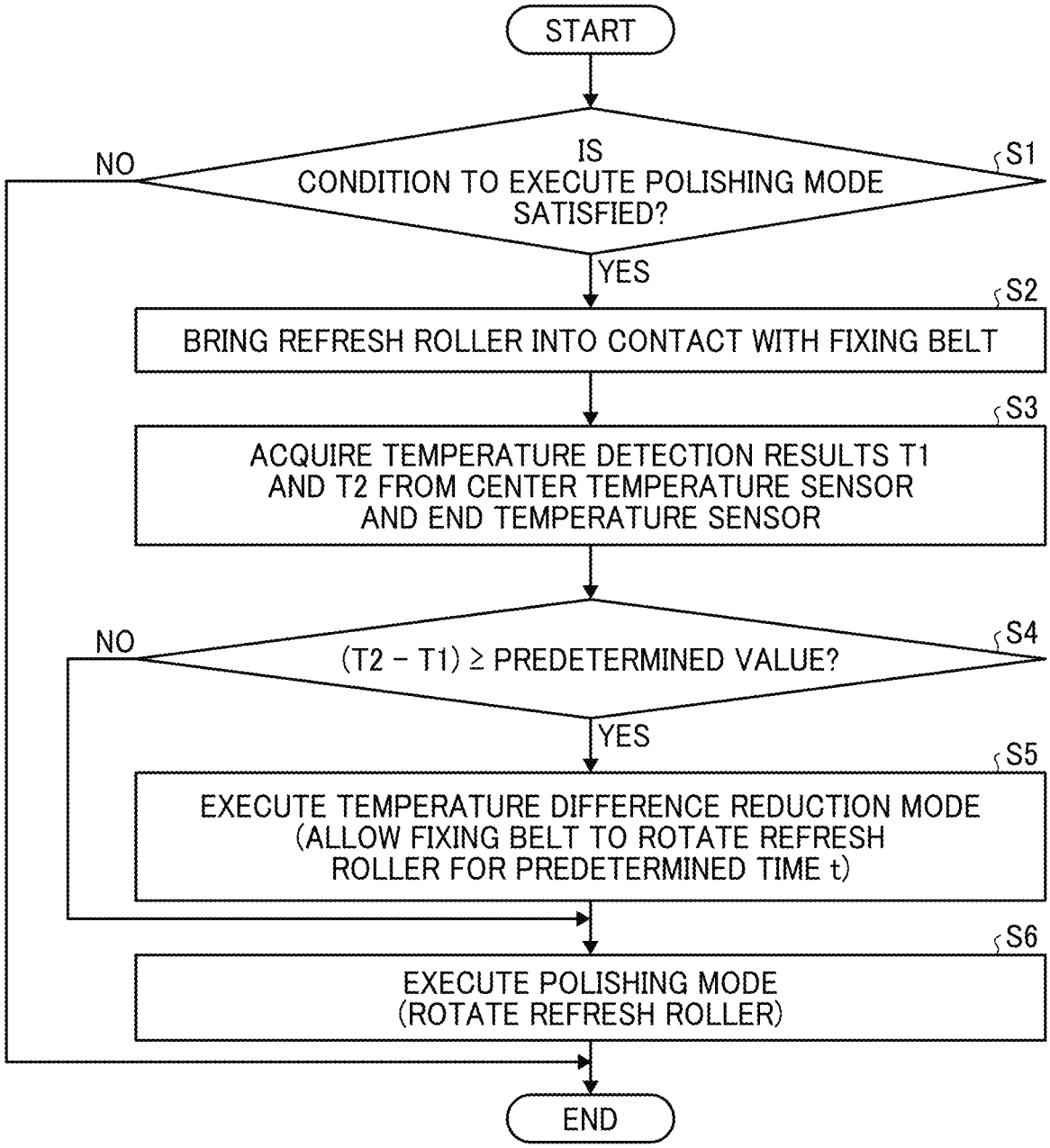
FIG. 8 is a flowchart illustrating a control flow of a polishing mode and a temperature difference reduction mode according to the embodiment.

FIG. 8 is a flowchart illustrating a control flow of the polishing mode and the temperature difference reduction mode according to present the embodiment.

The controller 400 according to the present embodiment determines whether a condition to execute the polishing mode is satisfied at a predetermined timing such as a timing after the job end, that is, the timing after the image forming operations are finished in step SL. Examples of the condition to execute the polishing mode include a condition that the sliding trace (that is the sheet edge streak) may be formed on the outer circumferential surface of the fixing belt 41, such as a condition that a predetermined number of sheets each having the width smaller than the maximum sheet width continuously pass through the fixing device.

If the controller 400 determines that the condition to execute the polishing mode is satisfied (Yes in step S1), the controller 400 controls the motor 48*a* to rotate the eccentric cam 48 to the rotation position illustrated in FIG. 3 and brings the refresh roller 46 into contact with the fixing belt 41 in step S2. Next, the controller 400 of the present embodiment determines whether the controller 400 executes the temperature difference reduction mode before executing the polishing mode.

Specifically, the controller 400 acquires temperature detection results T1 and T2 in step S3. The temperature detection result T1 is given by the center temperature sensor 49A that detects the temperature of the center portion of the fixing belt 41 in the sheet width direction. The temperature detection result T2 is given by the end temperature sensor 49B that detects the temperature of the end portion of the fixing belt 41 in the sheet width direction. The temperature detection result T1 represents the temperature in the sheet-contact area, that is, a part of the outer circumferential surface of the fixing belt 41 that has come into contact with the sheets P that have passed through the fixing nip until the center temperature sensor 49A detects the temperature. The temperature detection result T2 represents the temperature in the non-sheet-contact area, that is, a part of the outer circumferential surface of the fixing belt 41 that has not come into contact with the sheets P that have passed through the fixing nip until the end temperature sensor 49B detects the temperature.

Subsequently, the controller 400 subtracts the temperature detection result T1 (the temperature in the sheet-contact area) given by the center temperature sensor 49A from the temperature detection result T2 (the temperature in the non-sheet-contact area) given by the end temperature sensor 49B to obtain a temperature difference (T2−T1) and determines whether the temperature difference (T2−T1) is equal to or larger than a predetermined value in step S4.

If the controller 400 determines that the temperature difference (T2−T1) is equal to or larger than the predetermined value (Yes in step S4), a large step height occurs at the boundary between the sheet-contact area and the non-sheet-contact area on the fixing belt 41. If the controller 400 executes the polishing mode, the refresh roller 46 rubs and polishes the fixing belt 41 but does not appropriately polish the fixing belt 41 on the vicinity of the large step height, and polishing failure occurs. It is difficult to sufficiently reduce the sliding trace (that is the sheet edge streak).

For this reason, the controller 400 executes the temperature difference reduction monde to reduce the temperature difference (T2−T1) in step S5 before executing the polishing mode in a case that the controller 400 determines that the temperature difference (T2−T1) is equal to or greater than the predetermined value (Yes in step S4). Specifically, the controller 400 as the circuitry executes an operation in which rotations of the fixing belt 41 drive and rotate the refresh roller 46 in contact with the fixing belt 41 for a predetermined time t.

In general, as the relative velocity difference between the refresh roller 46 and the fixing belt 41 is smaller, the heat of the fixing belt 41 is more easily transmitted to the refresh roller 46. Since a heat transfer rate from a high temperature portion of the fixing belt 41 (that is, the non-sheet-contact area) to the refresh roller 46 is generally faster than a heat transfer rate from a low temperature portion of the fixing belt 41 (that is, the sheet-contact area) to the refresh roller 46, the temperature easily decreases in the non-sheet-contact area. Controlling a rotation operation of the refresh roller 46 so that a relative velocity difference between the fixing belt 41 and the refresh roller 46 in contact therewith is smaller than a relative velocity difference between the fixing belt 41 and the refresh roller 46 in the polishing mode reduces the temperature difference between the sheet-contact area and the non-sheet-contact area.

In particular, the refresh roller 46 in the present embodiment is brought into contact with a part of the outer circumferential surface of the fixing belt 41, and the part is wrapped around the fixing roller 42 having different outer diameters due to the difference of the thermal expansion. As a result, the part of the outer circumferential surface of the fixing belt 41 in contact with the refresh roller 46 deforms along the roller surface shape of the fixing roller 42 having the different outer diameters due to the difference of the thermal expansion. The part of the outer circumferential surface of the fixing belt 41 is dented in the sheet-contact area having a relatively low temperature and projects in the non-sheet-contact area having a relatively high temperature. A step height is formed in the part of the outer circumferential surface of the fixing belt 41. As a result, the refresh roller 46 comes into close contact with the fixing belt 41 projecting in the non-sheet-contact area but does not come into close contact with the fixing belt 41 dented in the sheet-contact area. The above-described difference in close contact situations in the present embodiment changes the heat transfer rate from the non-sheet-contact area of the fixing belt 41 to the refresh roller 46 to be faster than the heat transfer rate from the sheet-contact area of the fixing belt 41 to the refresh roller 46, which is likely to decrease the temperature.

In the temperature difference reduction mode according to the present embodiment, the rotations of the fixing belt 41 drive and rotate the refresh roller 46 so that the relative velocity difference between the refresh roller 46 and the fixing belt 41 is zero in order to efficiently reduce the temperature difference between the sheet-contact area and the non-sheet-contact area. However, the relative velocity difference between the refresh roller 46 and the fixing belt 41 in the temperature difference reduction mode is not limited to zero and may be smaller than the relative velocity difference in the polishing mode.

After the controller 400 executes the temperature difference reduction mode that rotates the refresh roller 46 for a predetermined time t, the controller 400 executes the polishing mode in step S6. In the polishing mode, the controller 400 controls the motor 46*a* to drive and rotate the refresh roller 46 in the corotating direction of the fixing belt 41. The rotation speed of the refresh roller 46 in the polishing mode is preferably set so that the surface moving speed (that is a linear velocity) of the refresh roller 46 is in a range from three to six times faster than the surface moving speed (that is a linear velocity) of the fixing belt 41.

As described above, if the temperature difference (T2−T1) is equal to or greater than the predetermined value (for example, 30° C.), the controller 400 in the present embodiment executes the temperature difference reduction mode and, after the temperature difference between the sheet-contact area and the non-sheet-contact area becomes small, the controller 400 executes the polishing mode. Even if the large temperature difference (T2−T1) forms the large step height at the boundary between the sheet-contact area and the non-sheet-contact area on the fixing belt 41, the above-described control decreases the temperature difference (T2−T1) and the step height before the refresh roller 46 polishes the fixing belt 41. Accordingly, the above-described control can prevent the polishing failure and sufficiently reduce the sliding trace (that is the sheet edge streak) even if the temperature difference (T2−T1) is equal to or greater than the predetermined value.

On the other hand, If the controller 400 determines that the temperature difference (T2−T1) is smaller than the predetermined value (for example, 30° C.)(No in step S4), the controller 400 executes the polishing mode in step S6 without executing the temperature difference reduction mode in step S5. In this case, since the step height formed at the boundary between the sheet-contact area and the non-sheet-contact area on the fixing belt 41 is small, the polishing failure does not occur, and the refresh roller 46 can sufficiently reduce the sliding trace (that is the sheet edge streak).

A description is now given of an experiment to confirm effects of the above-described control in the present embodiment.

In the experiment, the sheet edge streak occurred in the present embodiment in which the temperature difference reduction mode was executed before the execution of the polishing mode if the temperature difference (T2−T1) was equal to or greater than the predetermined value (that is 30° C.) was compared with the sheet edge streak occurred in a comparative embodiment in which the polishing mode was executed even if the temperature difference was equal to or greater than the predetermined value (the temperature difference reduction mode was not executed).

Table 1 below summarizes the results of the experiment. Table 1 includes the temperature difference between both end portions of the fixing belt 41 (that are the non-sheet-contact areas) and the center portion of the fixing belt 41 (that is the sheet-contact area) of the fixing belt 41 and evaluation grades of the sheet edge streaks after the polishing mode is executed in in the present embodiment and the comparative embodiment. Table 1 illustrates a relationship between the temperature differences and the evaluation grades of the sheet edge streaks. The larger the evaluation grade is, the less the sheet edge streak is.

TABLE 1

| Comparative Embodiment | | Linear velocity rate (Linear velocity of the refresh roller/Linear velocity of the fixing belt) | Outer diameter difference in the fixing roller | Grade of the sheet edge streak after polishing mode |
|---|---|---|---|---|
| Temperature difference (T2 − T1) | 20° C. | 3 to 6 times | 0.2 mm | Grade 4 |
| | 50° C. | 3 to 6 times | 0.5 mm | Grade 3 |
| **Present Embodiment** | | **Linear velocity rate (Linear velocity of the refresh roller/Linear velocity of the fixing belt)** | **Outer diameter difference in the fixing roller** | **Grade of the sheet edge streak after polishing mode** |
| Temperature difference (T2 − T1) | 20° C. | 3 to 6 times | 0.2 mm | Grade 4 |
| | 50° C. | First, the fixing belt rotates the refresh roller, and next, 3 to 6 times | 0.5 mm ↓ 0.2 mm | Grade 4 |

As illustrated in Table 1, when the temperature difference (T2−T1) between the non-sheet-contact area and the sheet-contact area was 20° C., the outer diameter difference between the non-sheet-contact area and the sheet-contact area on the roller surface of the fixing roller 42 was 0.2 mm. At this time, the evaluation grade of the sheet edge streak after the execution of the polishing mode in the comparative embodiment was grade 4 that was an acceptable level. Since the controller 400 according to the present embodiment did not execute the temperature reduction mode if the temperature difference (T2−T1) was 20° C., operations in the present embodiment was the same as the operations in the comparative embodiment, and the evaluation grade of the sheet edge streak after the execution of the polishing mode was the same as the evaluation grade in the comparative embodiment, that is, grade 4.

In contrast, when the temperature difference (T2−T1) between the non-sheet-contact area and the sheet-contact area was 50° C., the outer diameter difference between the non-sheet-contact area and the sheet-contact area on the roller surface of the fixing roller 42 was 0.5 mm as illustrated in Table 1. At this time, the evaluation grade of the sheet edge streak after the execution of the polishing mode in the comparative embodiment was grade 3 that was an unacceptable level. However, since the temperature difference (T2−T1) was equal to or greater than the predetermined value (i.e., 30° C.), the controller according to the present embodiment executed the temperature difference reduction mode and then executed the polishing mode. Executing the temperature difference reduction mode reduces the outer diameter difference between the non-sheet-contact area and the sheet-contact area to 0.2 mm. As a result, the evaluation grade of the sheet edge streak after the execution of the polishing mode was maintained at grade 4 that was the acceptable level.

The controller 400 according to the present embodiment executes the temperature difference reduction mode in order to prevent the polishing failure by the refresh roller 46, but the temperature difference reduction mode may be executed, for example, for the purpose of preventing other defects due to the large temperature difference between the sheet-contact area and the non-sheet-contact area.

For example, the above-described large temperature difference between the sheet-contact area and the non-sheet-contact area after the small sheets P each having the sheet width narrower than the maximum sheet width continuously pass through the fixing device 40 generates the uneven fixing temperature distribution in the sheet width direction when the fixing device fixes the image onto the large sheet having the width larger than the small sheet P. The uneven fixing temperature distribution in the sheet width direction causes uneven fixing properties in the sheet width direction, which may cause the abnormal image having different image quality parts such as an uneven gloss. In this case, executing the temperature difference reduction mode after a certain number of small sheets pass through the fixing device and before the fixing device fixes the image onto the large sheet reduces the uneven fixing temperature distribution in the large sheet and prevents the occurrence of the abnormal image having different image quality parts such as an uneven gloss.

In the present embodiment, the refresh roller 46 is used as an example of the contact rotator. However, the contact rotator may be a rotator different from the refresh roller 46 as long as the rotator rotates in contact with both the sheet-contact area and the non-sheet-contact area of the fixing belt 41.

Next, a variation of the temperature difference reduction mode is described.

Figure 9:
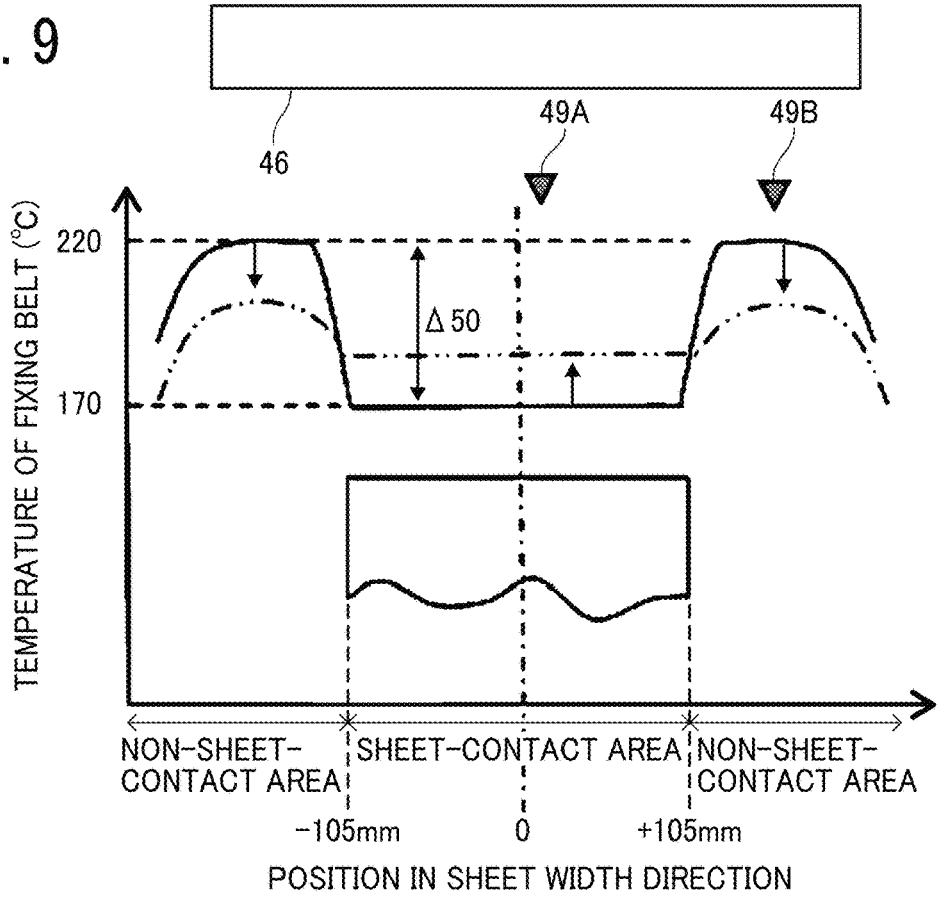
FIG. 9 is a graph illustrating a temperature distribution of the fixing belt in the sheet width direction after the sheets having the sheet width narrower than the maximum sheet width continuously pass through the fixing device in a variation.

FIG. 9 is a graph illustrating a temperature distribution of the fixing belt 41 in the sheet width direction after the sheets P each having the sheet width narrower than the maximum sheet width continuously pass through the fixing device 40 in the variation.

Figure 10:
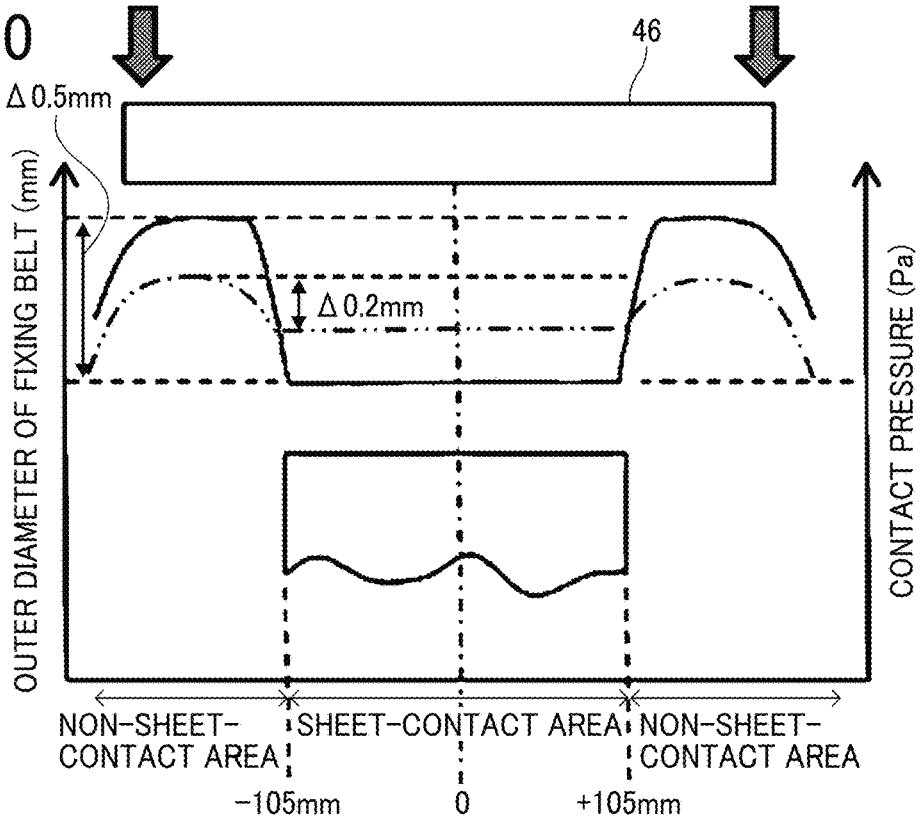
FIG. 10 is a graph illustrating an outer diameter profile of the fixing roller and a contact pressure distribution between the fixing belt and the refresh roller in the sheet width direction after the sheets having the sheet width narrower than the maximum sheet width continuously pass through the fixing device in the variation.

FIG. 10 is a graph illustrating an outer diameter profile of the fixing roller 42 and a contact pressure distribution between the fixing belt 41 and the refresh roller 46 in the sheet width direction after the sheets P each having the sheet width narrower than the maximum sheet width continuously pass through the fixing device 40 in the variation.

This variation has two different points from the above-described embodiment. One is the target temperature of the fixing belt 41 in the temperature difference reduction mode that is set to a temperature higher than the target temperature in the image forming operations. The other one is a heat pipe used for the core of the refresh roller 46.

Figure 11:
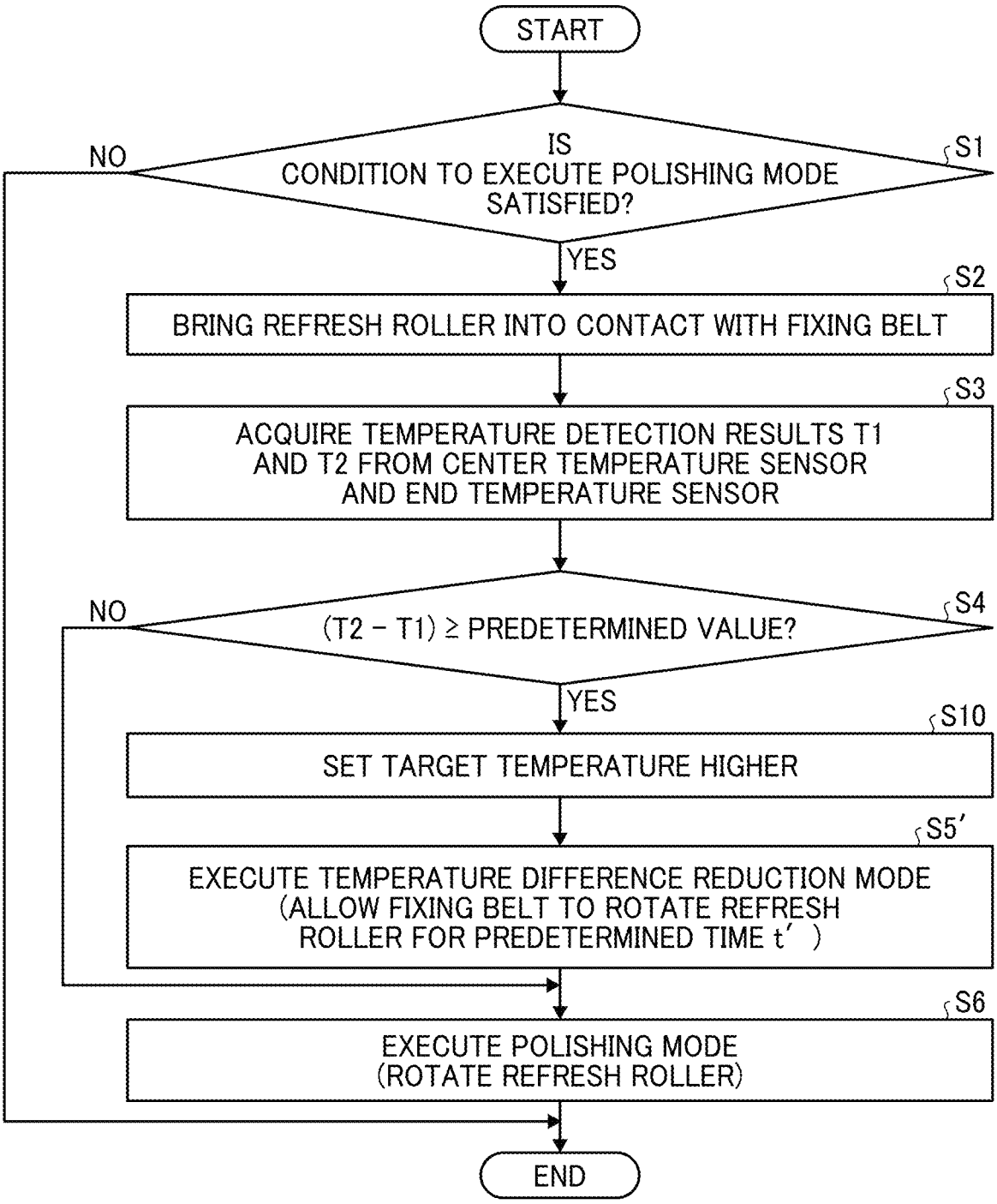
FIG. 11 is a flowchart illustrating a control flow of a polishing mode and a temperature difference reduction mode according to the variation.

FIG. 11 is a flowchart illustrating a control flow of the polishing mode and the temperature difference reduction mode according to this variation.

If the controller 400 according to this variation determines that the condition to execute the polishing mode is satisfied at the predetermined timing (Yes in step S1), the controller 400 controls the motor 48*a* to rotate the eccentric cam 48 and brings the refresh roller 46 into contact with the fixing belt 41 in step S2. Subsequently, the controller 400 acquires the temperature detection results T1 and T2 in step S3. The temperature detection result T1 represents the temperature in the sheet-contact area of the fixing belt 41. The temperature detection result T2 represents the temperature in the non-sheet-contact area of the fixing belt 41. The controller 400 subtracts the temperature detection result T1 from the temperature detection result T2 to obtain the temperature difference (T2−T1) and determines whether the temperature difference (T2−T1) is equal to or larger than the predetermined value in step S4. If the controller 400 determines that the temperature difference (T2−T1) is equal to or larger than the predetermined value (Yes in step S4), the controller 400 executes the temperature difference reduction mode in step S5.

In this variation, the controller 400 sets the target temperature of the fixing belt 41 during the temperature difference reduction mode to the temperature higher than the target temperature during the image forming operations in step S10. Thus, the temperature of the outer circumferential surface of fixing belt 41 is higher than the temperature during the image forming operations. As a result, the temperature distribution of the sheet-contact area in this variation as indicated by an alternate long and two short dashes line in FIG. 9 is higher than the temperature distribution of the sheet-contact area in the above-described embodiment in which the target temperature of the fixing belt 41 during the temperature reduction mode is the same as the target temperature of the fixing belt 41 during the image forming operations indicated by a solid line in FIG. 9 that is the same as the temperature distribution in FIG. 6. In the above-described control according to this variation, executing the temperature difference reduction mode brings the temperature of the sheet-contact area closer to the temperature of the non-sheet-contact area that is higher than the temperature of the sheet-contact area during the image forming operations.

In addition, the refresh roller 46 according to this variation includes a heat pipe as the core. The refresh roller 46 including the heat pipe as the core has a higher cooling ability cooling the fixing belt 41 (in other word, a higher heat transfer rate) than the refresh roller 46 including the core made of metal in the above-described embodiment. In particular, the temperature of the non-sheet-contact area that is in close contact with the refresh roller 46 is significantly lower than the temperature of the sheet-contact area that is not in close contact with the refresh roller 46. As a result, the temperature distribution of the non-sheet-contact area in this variation as indicated by the alternate long and two short dashes line in FIG. 9 is lower than the temperature distribution of the non-sheet-contact area in the above-described embodiment as indicated by the solid line in FIG. 9 that is the same as the temperature distribution in FIG. 6 despite setting the target temperature of the fixing belt 41 to the temperature higher than the target temperature during the image forming operations. Thus, executing the temperature difference reduction mode according to this variation brings the temperature of the non-sheet-contact area closer to the temperature of the sheet-contact area that is lower than the temperature of the non-sheet-contact area during the image forming operations.

As described above, executing the temperature reduction mode in this variation can more quickly reduce the temperature difference (T2−T1) between the sheet-contact area and the non-sheet-contact area as indicated by the alternate long and two short dashes line in FIG. 9 than executing the temperature reduction mode in the above-described embodiment. As a result, executing the temperature reduction mode in this variation shortens a time to reduce the step height on the fixing roller 42 to 0.2 mm as indicated by an alternate long and two short dashes line in FIG. 10 that is an allowable range. In other words, a predetermined time t' in step S5' for which the refresh roller 46 is driven to rotate in the temperature difference reduction mode according to this variation can be shorter than the predetermined time t in the above-described embodiment, and the processing time can be shortened.

This variation has two points, one is the target temperature of the fixing belt 41 in the temperature difference reduction mode that is set to a temperature higher than the target temperature in the image forming operations, and the other one is a heat pipe used for the core of the refresh roller 46. Note that the fixing device having either one of the two points has an advantage that shortens the processing time.

The configurations according to the above-descried embodiment and the variation are not limited thereto and can achieve the following aspects effectively.

First Aspect

In a first aspect, a fixing device such as the fixing device 40 includes a heater such as the fixing heater 45, a fixing rotator such as the fixing rotator configured by the fixing belt 41, the fixing roller 42, and the heating roller 43, a first temperature sensor such as the center temperature sensor 49A, a second temperature sensor such as the end temperature sensor 49B, a contact rotator such as the refresh roller 46, and circuitry such as the controller 400. The fixing rotator has an outer circumferential surface to come into contact with a sheet such as the sheet P. The heater heats the outer circumferential surface to fix an image onto the sheet. The outer circumferential surface has a first area such as the sheet-contact area and a second area such as the non-sheet-contact area. The first area comes into contact with both a first sheet such as the large sheet having a first sheet width such as the maximum sheet width and a second sheet such as the small sheet having a second sheet width narrower than the first sheet width. The second area comes into contact with the first sheet but does not come into contact with the second sheet. The first temperature sensor detects a first temperature such as the temperature detection result T1 of the first area. The second temperature sensor detects a second temperature such as the temperature detection result T2 of the second area. The contact rotator comes into contact with both the first area and the second area and rotate at one of at least two relative velocities with respect to the fixing rotator. The circuitry sets the one of the at least two relative velocities based on the first temperature and the second temperature.

Generally, in the rotation axis direction of the fixing rotator, the sheet-contact area in which the sheet comes into contact with the outer circumferential surface of the heated fixing rotator has a low temperature because heat is taken by the sheet P, and the non-sheet-contact area in which the sheet P does not come into contact with the outer circumferential surface of the heated fixing rotator has a high temperature because heat is not taken by the sheet. Continuously fixing the images onto second sheets each having the narrower width increases the temperature difference between the sheet-contact area and the non-sheet-contact area and causes various disadvantages.

For example, fixing the image onto the first sheet having the sheet width larger than the second sheet width after continuously fixing the images onto second sheets each having the narrower width increases the temperature difference between the sheet-contact area and the non-sheet-contact area causes temperature unevenness in the sheet-contact area of the fixing rotator that is the area in contact with the first sheet. This is because the sheet-contact area in contact with the first sheet includes both the sheet-contact area of the second sheet and the non-sheet-contact area of the second sheet. The temperature unevenness may cause the disadvantage such as image quality deterioration that is uneven image quality in the sheet.

When continuously fixing the images onto second sheets each having the narrower width increases the temperature difference between the sheet-contact area (that is, the first area) and the non-sheet-contact area (that is, the second area), thermal expansion increases the outer diameter of the part of the fixing roller in contact with the non-sheet-contact area having high temperature to be larger than the outer diameter of the part of the fixing roller in contact with the sheet-contact area having low temperature. As a result, the step height occurs between the sheet-contact area and the non-sheet-contact area on the outer circumferential surface of the fixing rotator. In the fixing device including the polishing roller as the contact rotator that rubs the outer circumferential surface of the fixing rotator to polish scratches or the like on the outer circumferential surface of the fixing rotator, the polishing roller cannot appropriately contact and polish a part of the outer circumferential surface in the vicinity of the step height. As a result, uneven polishing may occur on the outer circumferential surface of the fixing rotator.

The fixing device includes the contact rotator that contacts both the first area and the second area of the fixing rotator and rotates with a relative velocity difference with respect to the fixing rotator. Examples of the contact rotator include a polishing roller that polishes the fixing rotator, an external heating roller that heats the fixing rotator, and a tension roller that applies tension to the fixing rotator having a belt structure. In the first aspect, such a contact rotator is used to reduce the temperature difference between the first area and the second area described above.

Specifically, in general, the smaller the relative velocity difference between the contact rotator and the fixing rotator, the more easily the heat of the fixing rotator is transmitted to the contact rotator. Therefore, switching the rotation operation of the contact rotator that is driven to rotate with the relative velocity difference with respect to the fixing rotator so as to change the relative velocity difference enables switching the heat transfer state (that is, the heat transfer rate) from the fixing rotator to the contact rotator. Generally, the heat transfer rate from a portion of the fixing rotator having a temperature higher than other portions of the fixing rotator to the contact rotator is faster than the heat transfer rate from the other portions to the contact rotator. Therefore, the temperature of the portion having the higher temperature quickly decrease. Switching the rotation operation of the contact rotator to decrease the relative velocity difference with respect to the fixing rotator reduces the temperature difference between the sheet-contact area having the low temperature and the non-sheet-contact area having the high temperature.

In the first aspect, the first temperature sensor detects the first temperature of the first area, the second temperature sensor detects the second temperature of the second area, and the circuitry sets one of at least two relative velocities of the contact rotator with respect to the fixing rotator based on the first temperature and the second temperature. The above-described point enables setting the rotation speed of the contact rotator to decrease the relative velocity difference when the contact rotator such as the polishing roller that rotates with a large relative velocity difference with respect to the fixing rotator is used, and continuously fixing the images onto the sheets each having a small width causes the temperature difference between the sheet-contact area (that is, the first area) and the non-sheet-contact area (that is, the second area) of the fixing rotator. According to this configuration, the contact rotator such as the polishing roller for rubbing the fixing rotator can also be used to reduce the temperature difference between the areas caused by continuously fixing the images onto the sheets each having the small width, preventing the various disadvantages caused by the temperature difference.

Second Aspect

In a second aspect, the contact rotator of the fixing device according to the first aspect comes into contact with a portion of the fixing rotator in a direction in which the outer circumferential surface of the fixing rotator moves, and the portion thermally expands in a direction perpendicular to the outer circumferential surface of the fixing rotator.

In the second aspect, the part of the outer circumferential surface of the fixing rotator is dented in the sheet-contact area having the relatively low temperature and projects in the non-sheet-contact area having the relatively high temperature due to the thermal expansion difference. The step height is formed in the part of the outer circumferential surface of the fixing rotator in contact with the contact rotator. As a result, the contact rotator comes into close contact with the projecting non-sheet-contact area but does not come into close contact with the dented sheet-contact area. In the second aspect, the above-described difference of a contact state increases the heat transfer rate from the non-sheet-contact area of the fixing rotator to the contact rotator to be faster than the transfer rate from the sheet-contact area to the contact rotator and quickly decreases the temperature of the non-sheet-contact area. As a result, the fixing device according to the second aspect can reduce the temperature difference between the sheet-contact area having the low temperature and the non-sheet-contact area having the high temperature.

Third Aspect

In a third aspect, the circuitry in the fixing device according to the first aspect or the second aspect sets the one of the at least two relative velocities including a first relative velocity such as the relative velocity during the polishing mode and a second relative velocity such as the relative velocity during the temperature difference reduction mode that is slower than the first relative velocity based on a temperature difference such as the temperature difference (T2−T1) between the first temperature such as the first temperature T1 and the second temperature such as the second temperature T2. In addition, the circuitry sets the first relative velocity based on the temperature difference being less than a predetermined value to rotate the contact rotator at the first relative velocity. The circuitry sets the second relative velocity based on the temperature difference being equal to or higher than the predetermined value to rotate the contact rotator at the second relative velocity.

According to the third aspect, when the temperature difference between the sheet-contact area and the non-sheet-contact area becomes equal to or larger than the predetermined value, decreasing the relative velocity of the contact rotator with respect to the fixing rotator to the second relative velocity can reduce the temperature difference. The above-described circuitry can prevent the disadvantages caused when the temperature difference becomes large.

Fourth Aspect

In a fourth aspect, the circuitry in the fixing device according to the third aspect sets the second relative velocity to be zero and causes the contact rotator to rotate with rotation of the fixing rotator.

The above-described fixing device can quickly reduce the temperature difference between the sheet-contact area and the non-sheet-contact area.

Fifth Aspect

In a fifth aspect, the circuitry such as the controller 400 in the fixing device according to the third aspect or the fourth aspect controls a temperature of the fixing rotator, after the circuitry sets the second relative velocity, for example, during the temperature difference reduction mode, to be higher than a temperature of the fixing rotator while the contact rotator rotates at the first relative velocity, for example, while the polishing mode is performed.

As described in the above variation, the above-described fixing device can more quickly reduce the temperature difference between the sheet-contact area and the non-sheet-contact area.

Sixth Aspect

In a sixth aspect, the contact rotator in the fixing device according to any one of the first to fifth aspects includes a heat pipe extending in a rotation axis direction of the contact rotator.

As described in the above variation, the above-described fixing device can more quickly reduce the temperature difference between the sheet-contact area and the non-sheet-contact area.

Seventh Aspect

In a seventh aspect, the contact rotator in the fixing device according to any one of the first to sixth aspects includes a polishing layer as a surface layer.

According to the seventh aspect, the contact rotator contacts the fixing rotator and rotates with the relative velocity difference, and the polishing layer polishes the outer circumferential surface of the fixing rotator. The above-described configuration polishes the outer circumferential surface of the fixing rotator to reduce scratches such as sheet edge streaks that may occur on the outer circumferential surface of the fixing rotator.

When the part of the outer circumferential surface of the fixing rotator is dented in the sheet-contact area having the relatively low temperature and projects in the non-sheet-contact area having the relatively high temperature due to the thermal expansion difference, which forms the step height in the part of the outer circumferential surface of the fixing rotator in contact with the contact rotator, the large temperature difference between the sheet-contact area and the non-sheet-contact area increases the step height. Increasing the step height may cause polishing failure in which the contact rotator cannot appropriately polish the fixing rotator around the step height. As described above, since the temperature difference between the sheet-contact area and the non-sheet-contact area can be reduced in the seventh aspect, polishing failure can be prevented.

Eighth Aspect

In an eighth aspect, the circuitry in the fixing device according to the seventh aspect sets the one of the at least two relative velocities based on a temperature difference between the first temperature and the second temperature. In addition, the controller sets the one of the at least two relative velocities that is defined by a surface moving speed of the contact rotator being from three to six times faster than a surface moving speed of the fixing rotator based on the temperature difference being less than a predetermined value and rotates the contact rotator at the one of the at least two relative velocities in a rotation direction of the fixing rotator.

According to the eighth aspect, the contact rotator can sufficiently polish the outer circumferential surface of the fixing rotator and prevent the life of the fixing rotator from decreasing.

Ninth Aspect

In a ninth aspect, an image forming apparatus such as the image forming apparatus 100 includes a heater such as the fixing heater 45, a fixing rotator such as the fixing rotator configured by the fixing belt 41, the fixing roller 42, and the heating roller 43, a first temperature sensor such as the center temperature sensor 49A, a second temperature sensor such as the end temperature sensor 49B, a contact rotator such as the refresh roller 46, and circuitry such as the controller 400. The fixing rotator has an outer circumferential surface to come into contact with a sheet such as the sheet P. The heater heats the outer circumferential surface to fix an image onto the sheet. The outer circumferential surface has a first area such as the sheet-contact area and a second area such as the non-sheet-contact area. The first area comes into contact with both a first sheet such as the large sheet having a first sheet width such as the maximum sheet width and a second sheet such as the small sheet having a second sheet width narrower than the first sheet width. The second area comes into contact with the first sheet but does not come into contact with the second sheet. The first temperature sensor detects a first temperature such as the temperature detection result T1 of the first area. The second temperature sensor detects a second temperature such as the temperature detection result T2 of the second area. The contact rotator comes into contact with both the first area and the second area and rotate at one of at least two relative velocities with respect to the fixing rotator. The circuitry sets the one of the at least two relative velocities based on the first temperature and the second temperature.

According to the ninth aspect, since the contact rotator reduces the temperature difference between the sheet-contact area and the non-sheet-contact area on the outer circumferential surface of the fixing rotator, the image forming apparatus can prevent various disadvantages caused by the temperature difference.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention. Any one of the above-described operations may be performed in various other ways, for example, in an order different from the one described above.

The functionality of the elements disclosed herein may be implemented using circuitry or processing circuitry which includes general purpose processors, special purpose processors, integrated circuits, application specific integrated circuits (ASICs), digital signal processors (DSPs), field programmable gate arrays (FPGAs), conventional circuitry and/or combinations thereof which are configured or programmed to perform the disclosed functionality. Processors are considered processing circuitry or circuitry as they include transistors and other circuitry therein. In the disclosure, the circuitry, units, or means are hardware that carry out or are programmed to perform the recited functionality. The hardware may be any hardware disclosed herein or otherwise known which is programmed or configured to carry out the recited functionality. When the hardware is a processor which may be considered a type of circuitry, the circuitry, means, or units are a combination of hardware and software, the software being used to configure the hardware and/or processor.

What is claimed is:

1. A fixing device comprising:

a heater;

a fixing rotator having an outer circumferential surface to be heated by the heater and come into contact with a sheet to fix an image onto the sheet, the outer circumferential surface having a first area to come into contact with both a first sheet having a first sheet width and a second sheet having a second sheet width narrower than the first sheet width and a second area to come into contact with the first sheet and not to come into contact with the second sheet;

a first temperature sensor configured to detect a first temperature of the first area;

a second temperature sensor configured to detect a second temperature of the second area;

a contact rotator configured to come into contact with both the first area and the second area and rotate at one of at least two relative velocities with respect to the fixing rotator; and circuitry configured to:

set the one of the at least two relative velocities based on the first temperature and the second temperature;

set the one of the at least two relative velocities including a first relative velocity and a second relative velocity that is slower than the first relative velocity based on a temperature difference between the first temperature and the second temperature;

set the first relative velocity based on the temperature difference being less than a predetermined value and rotate the contact rotator at the first relative velocity;

set the second relative velocity based on the temperature difference being equal to or higher than the predetermined value and rotate the contact rotator at the second relative velocity; and set the second relative velocity to be zero and cause the contact rotator to rotate with rotation of the fixing rotator.

2. The fixing device according to claim 1, wherein:

the contact rotator is configured to come into contact with a portion of the fixing rotator in a direction in which the outer circumferential surface of the fixing rotator moves, the portion thermally expanding in a direction perpendicular to the outer circumferential surface of the fixing rotator.

3. The fixing device according to claim 1, wherein:

the circuitry is further configured to control a temperature of the fixing rotator, after the circuitry sets the second relative velocity, to be higher than a temperature of the fixing rotator while the contact rotator rotates at the first relative velocity.

4. The fixing device according to claim 1, wherein:

the contact rotator includes a heat pipe extending in a rotation axis direction.

5. The fixing device according to claim 1, wherein:

the contact rotator includes a polishing layer as a surface layer.

6. The fixing device according to claim 5, wherein the circuitry is further configured to:

set the one of the at least two relative velocities based on the temperature difference between the first temperature and the second temperature;

set the one of the at least two relative velocities that is defined by a surface moving speed of the contact rotator being from three to six times faster than a surface moving speed of the fixing rotator based on the temperature difference being less than a predetermined value; and rotate the contact rotator at the one of the at least two relative velocities in a rotation direction of the fixing rotator.

7. An image forming apparatus comprising:

an image generator;

a heater;

a fixing rotator having an outer circumferential surface to be heated by the heater and come into contact with a sheet to fix an image onto the sheet, the outer circumferential surface having a first area to come into contact with both a first sheet having a first sheet width and a second sheet having a second sheet width narrower than the first sheet width and a second area to come into contact with the first sheet and not to come into contact with the second sheet;

a first temperature sensor configured to detect a first temperature of the first area;

a second temperature sensor configured to detect a second temperature of the second area;

a contact rotator configured to come into contact with both the first area and the second area and rotate at one of at least two relative velocities with respect to the fixing rotator; and circuitry configured to:

set the one of the at least two relative velocities based on the first temperature and the second temperature;

set the one of the at least two relative velocities including a first relative velocity and a second relative velocity that is slower than the first relative velocity based on a temperature difference between the first temperature and the second temperature;

set the first relative velocity based on the temperature difference being less than a predetermined value and rotate the contact rotator at the first relative velocity;

set the second relative velocity based on the temperature difference being equal to or higher than the predetermined value and rotate the contact rotator at the second relative velocity; and set the second relative velocity to be zero and cause the contact rotator to rotate with rotation of the fixing rotator.

8. A fixing device comprising:

a heater;

a fixing rotator having an outer circumferential surface to be heated by the heater and come into contact with a sheet to fix an image onto the sheet, the outer circumferential surface having a first area to come into contact with both a first sheet having a first sheet width and a second sheet having a second sheet width narrower than the first sheet width and a second area to come into contact with the first sheet and not to come into contact with the second sheet;

a first temperature sensor configured to detect a first temperature of the first area;

a second temperature sensor configured to detect a second temperature of the second area;

a contact rotator configured to come into contact with both the first area and the second area and rotate at one of at least two relative velocities with respect to the fixing rotator, the contact rotator including a polishing layer as a surface layer; and circuitry configured to:

set the one of the at least two relative velocities based on the first temperature and the second temperature;

set the one of the at least two relative velocities based on a temperature difference between the first temperature and the second temperature;

set the one of the at least two relative velocities that is defined by a surface moving speed of the contact rotator being from three to six times faster than a surface moving speed of the fixing rotator based on the temperature difference being less than a predetermined value; and rotate the contact rotator at the one of the at least two relative velocities in a rotation direction of the fixing rotator.

* * * * *